US007178224B2

(12) United States Patent
Bussey, Jr. et al.

(10) Patent No.: US 7,178,224 B2
(45) Date of Patent: Feb. 20, 2007

(54) APPARATUS FOR MAKING A DRAINAGE ELEMENT

(76) Inventors: Harry Bussey, Jr., 960 Cape Marco Dr., Unit 1803, Marco Island, FL (US) 33937; Buddy Harry Bussey, III, 4 Windy Hill, Atlantic Highlands, NJ (US) 07716

( * ) Notice: Subject to any disclaimer, the term of this patent is extended or adjusted under 35 U.S.C. 154(b) by 167 days.

(21) Appl. No.: 10/960,615

(22) Filed: Oct. 7, 2004

(65) Prior Publication Data

US 2006/0075619 A1 Apr. 13, 2006

(51) Int. Cl.
*B23P 19/04* (2006.01)

(52) U.S. Cl. ..... 29/728; 29/779; 29/819; 29/407.09; 53/469; 53/473; 405/45

(58) Field of Classification Search ..... 29/890.14, 29/407.09, 407.1, 417, 429, 728, 779, 819, 29/820, 234, 525.01; 53/576, 469, 473, 435, 53/409; 405/36, 43, 45; 406/10
See application file for complete search history.

(56) References Cited

U.S. PATENT DOCUMENTS 4,104,774 A * 8/1978 Overmyer et al. ..... 29/234
4,716,712 A * 1/1988 Gill ..... 53/523
5,015,123 A * 5/1991 Houck et al. ..... 405/45
5,051,028 A * 9/1991 Houck et al. ..... 405/45
5,154,543 A * 10/1992 Houck et al. ..... 405/303
5,535,499 A * 7/1996 Houck et al. ..... 29/428
5,657,527 A * 8/1997 Houck et al. ..... 29/429
6,173,483 B1 * 1/2001 Houck et al. ..... 29/407.09
6,497,031 B1 * 12/2002 Houck et al. ..... 29/429
6,745,547 B2 * 6/2004 Bussey et al. ..... 53/576
6,854,924 B2 * 2/2005 Ring ..... 405/45
2003/0205035 A1 * 11/2003 Bussey et al. ..... 53/576

* cited by examiner

*Primary Examiner*—Jermie E. Cozart
(74) *Attorney, Agent, or Firm*—Francis C. Hand; Carella, Byrne, Bain, et al

(57) ABSTRACT

An apparatus is provided for making drainage elements in a vertical manner. In one embodiment, a vertically disposed hollow rotatable mandrel with a screw-threaded flight is used for guiding a length of perforated pipe and filling an annular space between the pipe and a cylinder of mesh material secured at one end to the pipe with aggregate. A hopper is used for directing the aggregate into the space between the mandrel and a cylindrical outlet of the hopper. A motor for driving the mandrel may be reversed at a slower speed than the forward speed to stop delivery of aggregate and to allow time for the upper end of the cylinder of mesh material to be severed and secured to the pipe to form a drainage element as well as to allow severance of the pipe. In another embodiment, the perforated pipe is driven through the hopper and the aggregate flows under gravity into the mesh sleeve.

31 Claims, 5 Drawing Sheets

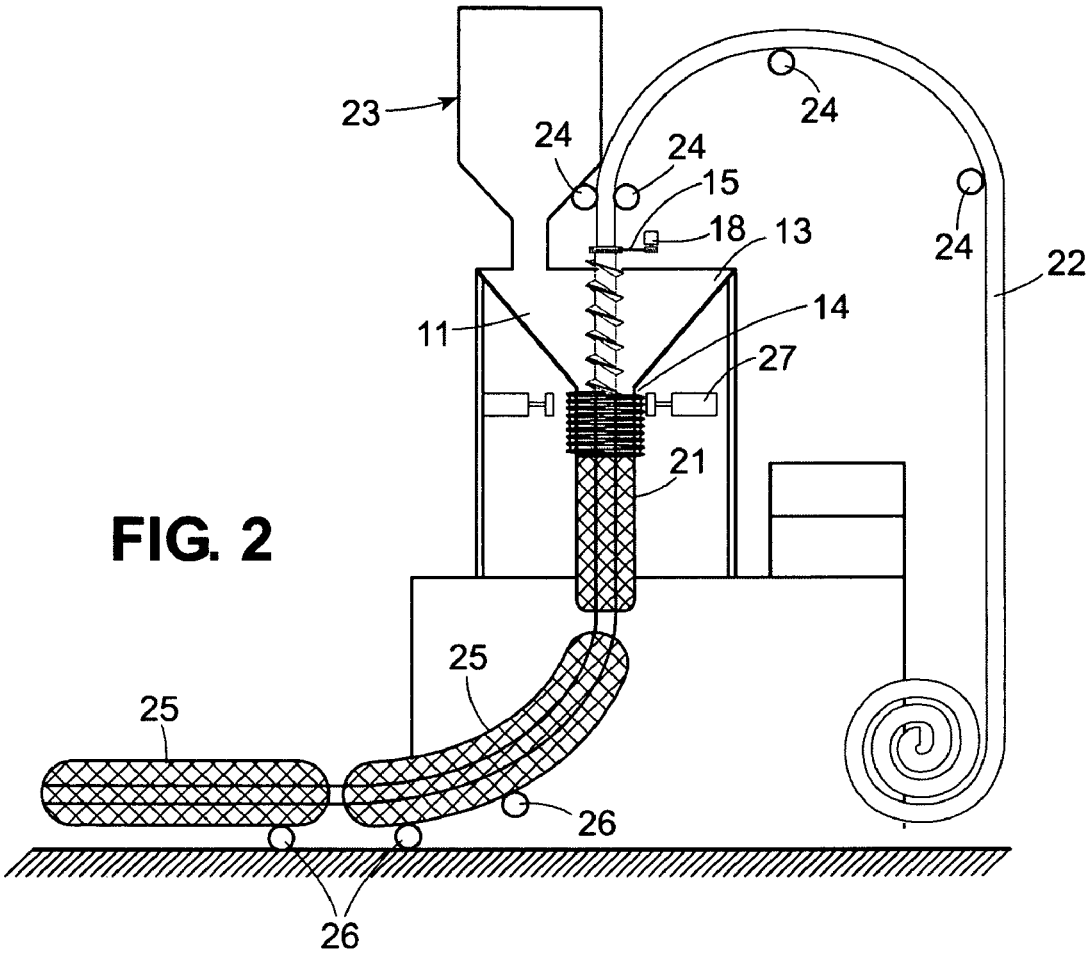
FIG. 2
FIG. 3
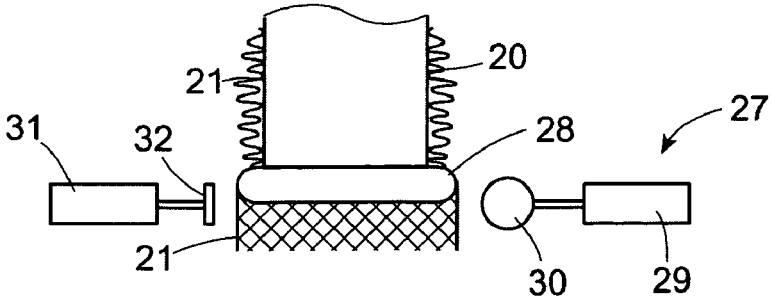
FIG. 4
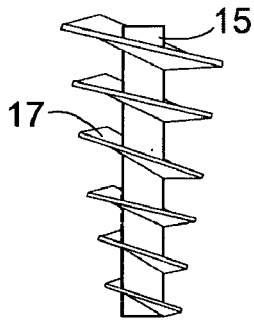

APPARATUS FOR MAKING A DRAINAGE ELEMENT

This invention relates to an apparatus and method for making a drainage element. More particularly, this invention relates to an apparatus and method for making a drainage element for use in a sewage field, water drainage field, roadside drainage ditches and the like.

As is known, drainage elements have been constructed of a perforated plastic pipe surrounded by loose aggregate, such as foam plastic elements, beads, and other light weight materials. Various techniques have been known for making such drainage elements in a manufacturing plant so that the individual drainage elements may then be shipped to a construction site for use. Examples of such techniques are described in U.S. Pat. Nos. 5,015,123; 5,154,543; 5,535,499; 5,657,527; and 6,173,483.

As described in U.S. Pat. No. 5,015,123, a coil of perforated plastic pipe may be uncoiled and passed through a horizontally disposed hollow mandrel while loose fill aggregate in the form of foam plastic elements is deposited under gravity from a hopper between the flights of a screw on the outside of the mandrel. Thus, as the mandrel rotates, the loose fill aggregate is moved by the flights along with the pipe. In addition, a sleeve of mesh material is mounted about the end of the mandrel and tied to the pipe. During operation, as the mandrel rotates, the loose fill material is driven forward into the space between the sleeve of mesh material and the pipe. This causes the pipe and the sleeve of mesh material tied to the pipe to move forwardly away from the mandrel. This apparatus functions in the manner of an extruder to drive the loose fill material into the space between the mesh material and the pipe thereby causing the pipe to move forwardly.

However, one of the drawbacks of this type of apparatus is that the loose fill material is not uniformly dispensed about the circumference of the mandrel and thus of the finished product. As a result, once the drainage elements are placed in a field, there may be non-uniformity in the manner in which the drainage elements function. Further, should a need arise to stop the mandrel in order to tie the rear end of the sleeve of mesh material to the pipe, the loose fill material at the front end of the mandrel may spill out of the apparatus. Also, since the mandrel is typically mounted in a cantilevered manner, the mandrel deflects over its length and may come into contact with the barrel in which the mandrel is mounted thereby causing wear.

Another drawback for this type of apparatus is that the apparatus cannot be reversed, for example, in case there is a need to unblock a jam in the flow of loose fill material in the apparatus. Also, the feeding of the loose fill aggregate perpendicularly of the screw would cause cutting of the individual elements of the aggregate, that, in turn, may create dust.

Accordingly, it is an object of this invention to provide an apparatus and method for making drainage elements of uniform construction.

It is an object of this invention of to provide a simple apparatus for making drainage elements of plastic pipe and surrounding aggregate.

It is another object of the invention to provide a simple technique for placing loose aggregate about a perforated pipe for making a drainage element.

It is another object of the invention to reduce wear in an apparatus for making drainage elements.

It is another object of the invention to reduce inadvertent spillage of aggregate from an apparatus for making drainage elements.

It is another object of the invention to fabricate drainage elements along a vertical axis.

Briefly, the invention provides an apparatus for making drainage elements that employs a hopper that is disposed about a vertical axis for receiving a supply of loose aggregate. This hopper includes an outlet of cylindrical shape that is disposed to receive a collapsed cylinder of mesh material about a lower end. In addition, the apparatus includes means for guiding a length of material, such as a perforated pipe, through the hopper and concentrically into the outlet of the hopper. During use, the aggregate is dispensed through the outlet of the hopper into an annular space between the length of the material passing out of the hopper and the elongating cylinder of mesh material secured at one end to and moving with the length of material.

In one embodiment, the apparatus includes a metering means for moving aggregate from the hopper through the outlet of the hopper and circumferentially about the length of material in a uniform manner while pushing the aggregate through the outlet of the hopper into an annular space between the length of material passing out of the hopper and the elongating cylinder of mesh material secured at one end to and moving with the length of material.

One of the advantages of the metering means is that the loose aggregate is laid down in a uniform manner completely about the outer periphery of the length of material. Another advantage is that the loose aggregate is moved along "in line" so that the aggregate does not have to turn any angle in order to be fed into the cylinder of mesh material. This is a particular advantage over previously known structures in which a hopper is located on an axis perpendicular to a screw for feeding the aggregate along a horizontal axis.

The metering means may be of a mechanical or pneumatic type. For example, in one embodiment, the metering means includes a hollow mandrel that extends through the hopper and that has a bore for passage of the length of material, e.g. a perforated plastic pipe. In addition, the mandrel has a screw-threaded flight extending about and along the outer periphery for pushing the aggregate through the outlet of the hopper. In this embodiment, the flight on the mandrel has an outer diameter sufficiently smaller than an internal diameter of the lower cylindrical portion of the hopper in order to block loose aggregate from backing up into the hopper during relative rotation between the mandrel and the hopper while also being able to move aggregate downward without contacting the wall of the outlet of the hopper.

In another embodiment, the metering means may be constructed on a pneumatic principle whereby the loose aggregate is deposited circumferentially about the pipe as the pipe proceeds through the hopper.

The invention also provides a method of making a drainage element wherein loose aggregate in a hopper is placed circumferentially about a vertically disposed perforated plastic pipe and in a uniform manner while the pipe moves downwardly along with a cylinder of mesh material that is tied at one end to the pipe.

The loose aggregate is metered to flow about the circumference of the perforated pipe in a uniform manner and is pushed forwardly to cause the pipe and the cylinder of mesh material tied thereto to move downwardly.

Since the loose aggregate can be placed about the perforated pipe in a uniform manner, the resulting drainage element has uniform drainage characteristics. Likewise, all of the drainage elements made by the apparatus and method will have uniform drainage characteristics.

The apparatus also produces drainage elements that are tightly packed with aggregate.

Where the metering means is constructed as a hollow mandrel with a screw-threaded flight, use is made of a motor that is operatively connected to the mandrel for rotating the mandrel about a vertical axis. In addition, means may also be provided for selectively reversing the operation of the motor in order to reverse the rotation of the hollow mandrel, for example at a slower speed. This provides for a stoppage in flow of the aggregate from the hopper into the cylinder of mesh material. This stoppage in flow also provides a time delay within which the upper part of the cylinder of mesh material may be secured to the length of material, for example a perforated pipe in order to form a drainage unit. Time is also provided within which the perforated pipe may be severed so as to form a discrete drainage element and to secure the cylinder of mesh material to the end of the pipe depending from the hopper to begin the formation of a further drainage element.

The screw-threaded mandrel may also be provided with a flight that has an outer diameter sufficiently smaller than the internal diameter of the hopper outlet in order to block loose aggregate from backing up into the hopper from the outlet during relative rotation between the mandrel and the hopper while causing the aggregate to move downward. In addition, the flight may have a larger diameter at an upper end than at the lower end. This configuration serves to cause a cramming action for packing the aggregate into the cylinder of mesh material in a more dense manner.

In another embodiment, a pair of drive rolls are provided for driving the length of material, e.g. a perforated pipe, through the hopper. In this embodiment, a forward end of the cylinder of mesh material is secured to the perforated pipe so that as the pipe is driven forwardly by the drive rolls, the cylinder of mesh is played off the outlet of the hopper and the space between the pipe and mesh cylinder filled with aggregate that is dispensed under gravity.

The cylinder of mesh material may be mounted in a collapsed manner on a sleeve that is separately mounted on and about the outlet of the hopper. Thus, one cylinder of mesh material may be used to make a multiplicity of drainage elements. When the sleeve has been exhausted of mesh material, the sleeve may be replaced with a sleeve containing fresh mesh material for the formation of further drainage elements. Alternatively, an extension may be secured to the outlet of the hopper that has a bulbous cross-sectional shape for receiving the cylinder of mesh material on an upper section. Thus, as the mesh is pulled by the perforated pipe during a filling operation, the mesh expands radially to move over the bulbous section of the extension and then, after filling, contracts radially to tighten around the aggregate.

A brake means may be also provided about the outlet of the hopper in order to control the release of the cylinder of mesh material. In this respect, the brake means serves to restrain the playing-off of the mesh material cylinder from the sleeve. This causes a tighter packing of the aggregate into the mesh material cylinder as the perforated pipe and mesh material cylinder do not move unless the aggregate forces the pipe and mesh material cylinder to move downwardly.

The apparatus may be also used for filling a cylinder mesh material without any internal element being passed through the hollow mandrel.

In still another embodiment, a metered amount of aggregate is delivered into a hopper through a pipe that can be opened and closed and the aggregate is blown from the hopper through a gate that can be opened and closed into an outlet of the hopper about which the cylinder of mesh material is mounted.

These and other objects and advantages of the invention will become more apparent the following detailed description taken in conjunction with the accompanying drawing wherein:

FIG. 2 illustrates a schematic cross-sectional view of a modified apparatus in accordance with the invention;

FIG. 3 illustrates a cross-sectional view of a brake means used to restrain the playing-off of the cylinder of the mesh material accordance with the invention;

FIG. 4 illustrates a side view of a mandrel employing a flight with a variable diameter in accordance with the invention;

Figure 1:
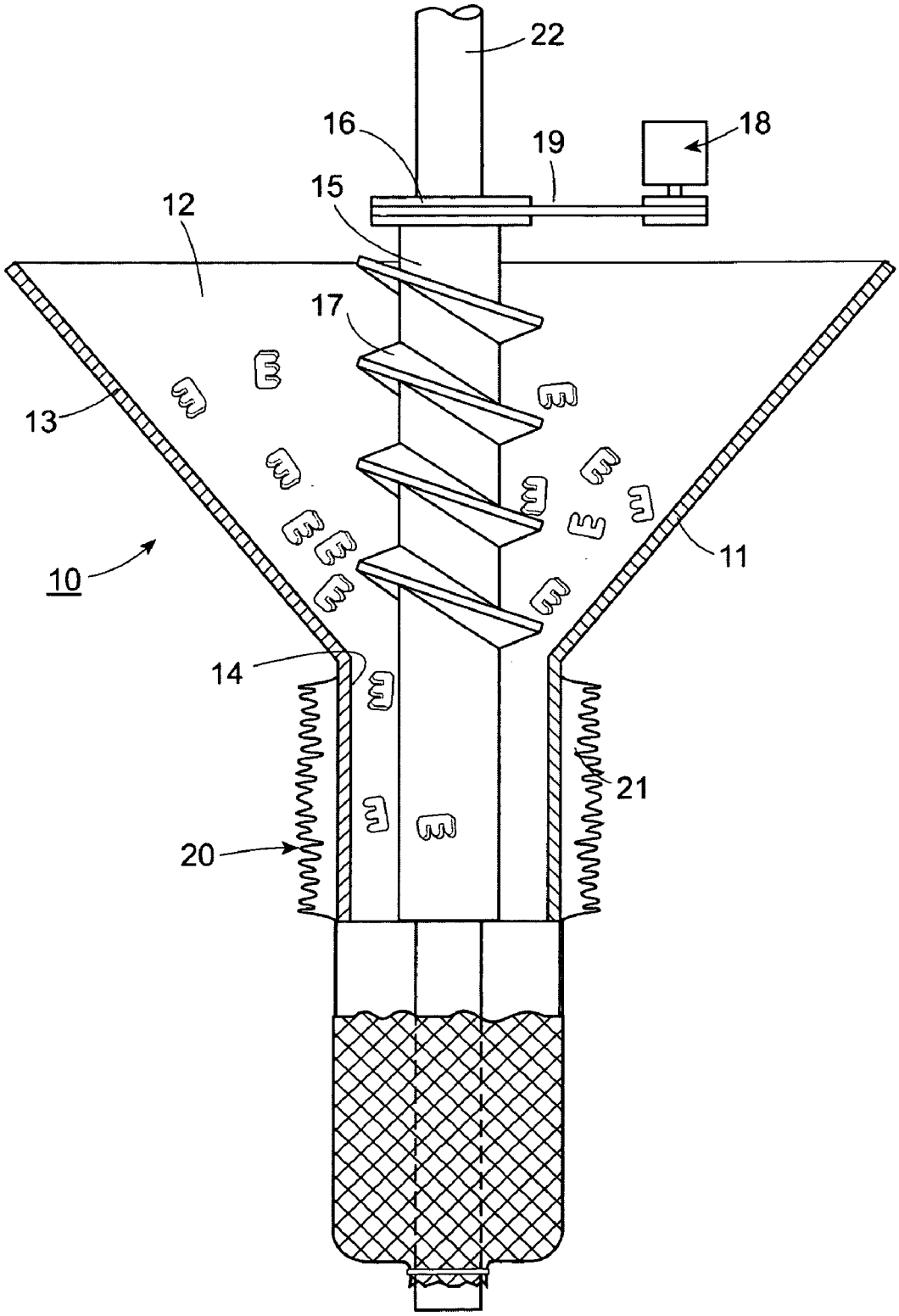
FIG. 1 illustrates a schematic cross-sectional view of an apparatus constructed in accordance with the invention.

Referring to FIG. 1, the apparatus 10 includes a hopper 11 that is disposed on a vertical axis for receiving a supply of loose aggregate 12, such as, loose fill elements of foamed plastic. The hopper 11 has an upper portion 13 of tapered or conical cross-sectional shape and a lower portion forming an outlet 14 of cylindrical shape. Typically, the hopper 11 is mounted in a fixed manner on a suitable frame (not shown). The hopper 11 is of a suitable size and is typically disposed so that loose aggregate 12 may be dumped into the upper portion of the hopper 11 on a batch basis or on a continuous basis.

The apparatus 10 also includes a metering means for moving aggregate through the outlet 14. For example, as illustrated, the metering means is in the form of a hollow mandrel 15 that extends through the hopper 11 and is disposed on the vertical axis of the hopper 11. The mandrel 15 has a centrally disposed bore 16 and a screw-threaded flight 17 that extends about and along an outer periphery of the mandrel 15 into the outlet 14 of the hopper 11. As illustrated, the flight 17 has a uniform diameter and pitch throughout the length of the mandrel 15. However, as shown in FIG. 4, the flight 17' on the mandrel 15 may have a non-uniform pitch and/or a non-uniform diameter throughout the length thereof.

A means in the form of a motor 18 is provided for rotating the mandrel 15 relative to the hopper 11 in order to effect movement of the aggregate 12 from the upper portion 13 of the hopper 11 into the outlet 14 of the hopper 11. Alternatively, any other suitable means may be provided for rotating the mandrel 15.

As illustrated, the motor 18 drives an endless belt 19 which is disposed about the mandrel 15 in order to rotate the mandrel 15.

The motor 18 is, in turn, provided with a means (not shown) for selectively reversing operation of the motor 18 in order to rotate the mandrel 15 in an opposite direction and at a lower return speed than the forward speed. In this respect, the motor 18 may be reversed so that the mandrel 15 rotates in an opposite direction such that aggregate 12 is not directed into the outlet 14. At the same time, aggregate in the outlet 14 is prevented from passing out of the outlet 14 but is instead moved back into the upper portion of the hopper 11.

The flight 17 of the mandrel 15 is of an outer diameter sufficiently smaller than the internal diameter of the outlet 14 in order to block loose aggregate from backing up from the outlet 14 into the upper portion 13 of the hopper 11 during normal rotation of the mandrel 15 and to move aggregate 12 downward without the flight 17 touching the inside wall of the outlet 14. In this respect, the inside wall of the outlet 14 may be coated with a suitable material, such as polytetrafluoroethylene, to allow the aggregate 12 to slide through. In addition, the flight 17 of the mandrel 15 may be coated with the same or similar material in order to provide a slide surface. Typically, the mandrel 15 is made of metal and is grounded.

The outlet 14 of the hopper 11 is sized to receive a cylindrical sleeve 20 having a collapsed cylinder of mesh material 21 thereon. Typically, the mesh material 21 is made of a plastic material of sufficient strength to retain the aggregate 12 in place and with relatively large mesh openings to permit a free flow of water and/or sewage therebetween.

The apparatus 10 also has a means (not shown) for mounting a coiled length of material, e.g. a length of perforated plastic pipe 22 above the hopper 11. The pipe 22 is of any suitable structure for use in carrying water and/or sewage. Likewise, the pipe 22 is provided with perforations (not shown) suitable for use in water and/or sewage treatment. The pipe 22 is otherwise of conventional structure and need not be further described.

In use, the plastic pipe 22 is first passed, e.g. manually, through the bore 16 in the hollow mandrel 15 and exposed below the outlet 14 of the hopper 11. The mandrel 15 thus acts as a means for guiding the pipe 22 through the outlet 14 of the hopper 11. Alternatively, the plastic pipe 22 may be delivered automatically through the use of drive rollers. One end of the cylinder of mesh material 21 is then tied about the plastic pipe 22 and secured in place in a suitable manner. A charge of aggregate 12 is then placed in the hopper 11 and the motor 18 started to cause the mandrel 15 to begin rotation. As a result, the flight 17 on the mandrel 15 pushes the aggregate 12 downwardly into the outlet 14 of the hopper 11. During this time, the aggregate 12 is uniformly laid into the outlet 14 of the hopper 11 in a circumferential manner about the periphery of the mandrel 15. Continued rotation of the mandrel 15 causes the aggregate 12 in the outlet 14 of the hopper 11 to pass out of the hopper 11 into the space between the pipe 22 and the mesh material 21. This, in turn, causes the pipe 22 and the mesh material 21 tied thereto to move downwardly away from the hopper 11 while being simultaneously stuffed with aggregate 12 in a uniform circumferential manner.

As the mandrel 15 continues to rotate, aggregate 12 is metered out of the outlet 14 circumferentially about the pipe 22 and within the cylinder of mesh material 21. As the flight 17 of the mandrel 15 crams additional aggregate into the cylinder of mesh material 21, the pipe 22 is caused to move downwardly thereby pulling the mesh material 21 therewith. This in turn plays-off the mesh material 21 from the sleeve 20.

When the pipe 22 has been pushed downwardly a desired extent, the motor 18 is reversed at a lower speed. This causes the mandrel 15 to reverse and rotate at a slower speed. At a result, aggregate 12 is no longer passed from the outlet 14 of the hopper but instead is moved upwardly from within the outlet 14 into upper portion 13 of the hopper 11. That is to say, aggregate 12 is no longer passed into the mesh material cylinder 21.

During this time, the cylinder of mesh material 21 is severed by suitable means (not shown) and the rear end of the mesh material 21 is secured to the pipe 22. Thereafter, the pipe 22 is severed by suitable means (not shown) upstream of the point at which the mesh material 21 has been secured to the pipe 22 in order to form a discrete drainage element.

Next, the free end of the mesh material 21 on the sleeve 20 is secured to the depending section of pipe 22 that extends from the outlet 14 of the hopper 11 to begin the formation of a further drainage element.

Typically, the cylinder of mesh material 21 is of length to form a plurality of drainage elements. Once a sleeve 20 has been emptied of mesh material 21, the sleeve 20 may be replaced by a fresh sleeve 20 with mesh material 21 thereon for the formation of additional drainage elements.

Referring the FIG. 2, wherein like reference characters indicate like parts as above, an overhead hopper 23 may be provided for introducing aggregate 12 into the upper portion 14 of the hopper 11, for example on a batch basis or a continuous basis.

The length of material 22 may be supplied in coil form and disposed at floor level adjacent to the side of the apparatus 10. In addition, the length of material 22 may be delivered via a plurality of guide rolls 24 in an overhead manner for delivery into the hollow bore of the mandrel 15.

The apparatus may also be constructed so that drainage elements 25 are generated in a link-to-link manner. In this case, after a cylinder of mesh material has been filled and secured to the pipe 22, the pipe 22 is not severed but is continuously moved from the outlet of the hopper 11. For this purpose, a plurality of guide rolls 26 are provided to guide the linked drainage elements 25 from a vertical disposition into a horizontal disposition.

The linked drainage elements 25 may be separated at a remote station (not shown) by simply cutting though the exposed length of pipe 22 between the drainage elements 25. The drainage elements 25 may be sized of any suitable length such as from 6 feet to 10 feet or more or less. Similarly, the diameter of the drainage elements may be of any suitable size.

A brake means 27 is also provided to retard the movement of the mesh material 21 from the sleeve 20. This allows a tighter packing of the aggregate into the mesh material since the mesh material does not move until the retarding force of the brake means 27 is overcome.

Referring to FIG. 3, the brake means 27 may include a removable annular shoe 28 that is provided on the sleeve 20 and is of larger diameter so that the mesh material 21 needs to expand on passing over the shoe 28. The brake means 27 also includes a piston and cylinder arrangement 29 having a rotatable wheel of 30 for pinching the mesh material 21 between the shoe 28 and the wheel 30 under a suitable retarding force that allows the mesh material 21 to be drawn off under tension.

The brake means 27 also includes a second piston and cylinder arrangement 31 employing a flat plate 32 for pinching the mesh material 21 between the shoe 28 and the plate 32 in a similar manner.

Since the hopper 11 is disposed on a vertical axis, the aggregate 12 is able to flow into and around the pipe 22 without voids being created about the pipe 22.

Further, the length of the outlet 14 of the hopper 11 may be held to a minimum since a metering means, such as the mandrel 15, remains full as opposed to previously known horizontally disposed structures.

The use of the rotating mandrel 15 provides for a more positive flow of aggregate 12 through the outlet 14 rather than a simple gravity flow. This helps to decrease breakage of the elements of the aggregate.

Further, use of the rotating mandrel 15 within the outlet 14 provides for a gentle movement of the aggregate 12. This, in turn, avoids cutting of the elements of the aggregate and the creation of dust.

The vertical arrangement of the mandrel 15 within the outlet 14 avoids the risk of wear as opposed to an arrangement in which a screw is horizontally disposed within a barrel with the possibility that any sag in the screw would allow the screw to touch the bottom of the barrel.

The use of a motor 18 that can be controlled for rotating the mandrel 15 allows the speed at which aggregate 12 is dispensed from the hopper 11 to be varied. This, in turn, can be used to provide for a better and fast packing of the resulting drainage elements.

Figure 5:
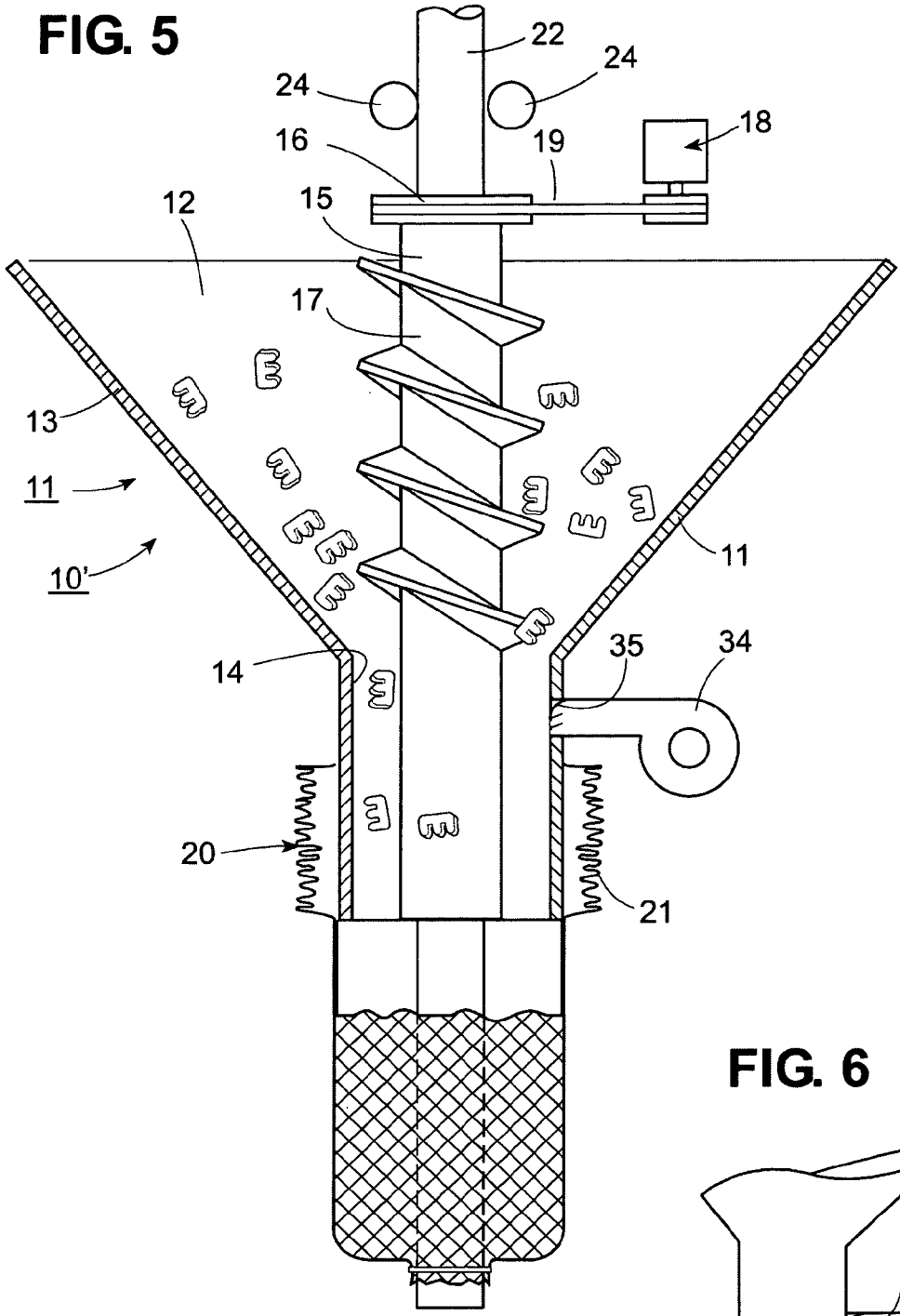
FIG. 5 illustrates a schematic cross-sectional view of a further modified apparatus in accordance with the invention.

Referring to FIG. 5, wherein like reference characters indicate like parts as above, the apparatus 10' may be constructed with a hollow sleeve (not shown) that extends throughout the length of the hopper 11 in order to act as a means for guiding the perforated pipe 22 though the hopper 11. The sleeve is fixedly mounted in the hopper 11 and fitted within the hollow mandrel 15 to allow relative rotation between the mandrel 15 and the stationary sleeve. For example, the sleeve may be fixedly secured in depending manner in a housing (not shown) located on a platform (not shown) secured across the upper end of the hopper 11 while the mandrel 15 is secured in a depending manner from a second housing (not shown) also located on the platform (not shown). A suitable opening or openings are provided in the platform for the introduction of the aggregate into the hopper 11.

In addition, the mandrel 15 is constructed with a screw 17 that terminates that stream of the cylindrical outlet 14 of the hopper 11. Thus, it is not necessary that the screw flights 17 extend into the outlet 14.

During operation, the aggregate 12 is metered by the screw 17 so as to moved circumferentially about the sleeve 15 and the pipe 22 passing therethrough. At the same time, the aggregate 12 is caused to flow under gravity into the outlet 14. As the aggregate 12 begins to backup within the outlet 14 during filling of the mesh material in 21, the screw 17 of the mandrel 15 places the aggregate 12 in the filled hopper outlet 14 under a slight pressure so as to advance the aggregate 12 into the mesh material 21.

Figure 6:
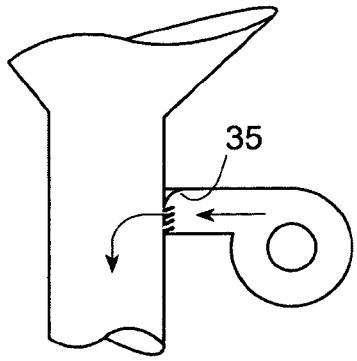
FIG. 6 illustrates an enlarged view of a blower employed with the apparatus of FIG. 5.

Referring to FIGS. 5 and 6, a blower or venturi 34 may be located along the hopper outlet 14 and used to blow air downwardly into the outlet 14 in order to impose a downward biasing force on the descending aggregate 12 in order to fill the mesh material in 21 in a compact manner.

As indicated in FIG. 5, the blower may communicate with the interior of the hopper outlet 14 by way of a screen that prevents any backup of aggregate 12 into the blower 34. In addition, the blower is provided with a suitable baffle or deflecting plate 35 in order to direct the flow of air in a downward direction upon entering the interior of the hopper outlet 14.

Still further, the apparatus may be used without supplying a length of material into the rotating mandrel 15. In this embodiment, the apparatus may be used to form a series of discrete drainage elements or a series of linked-to-linked drainage elements wherein each drainage element is constituted solely by the aggregate and the cylinder of mesh material.

Figure 7:
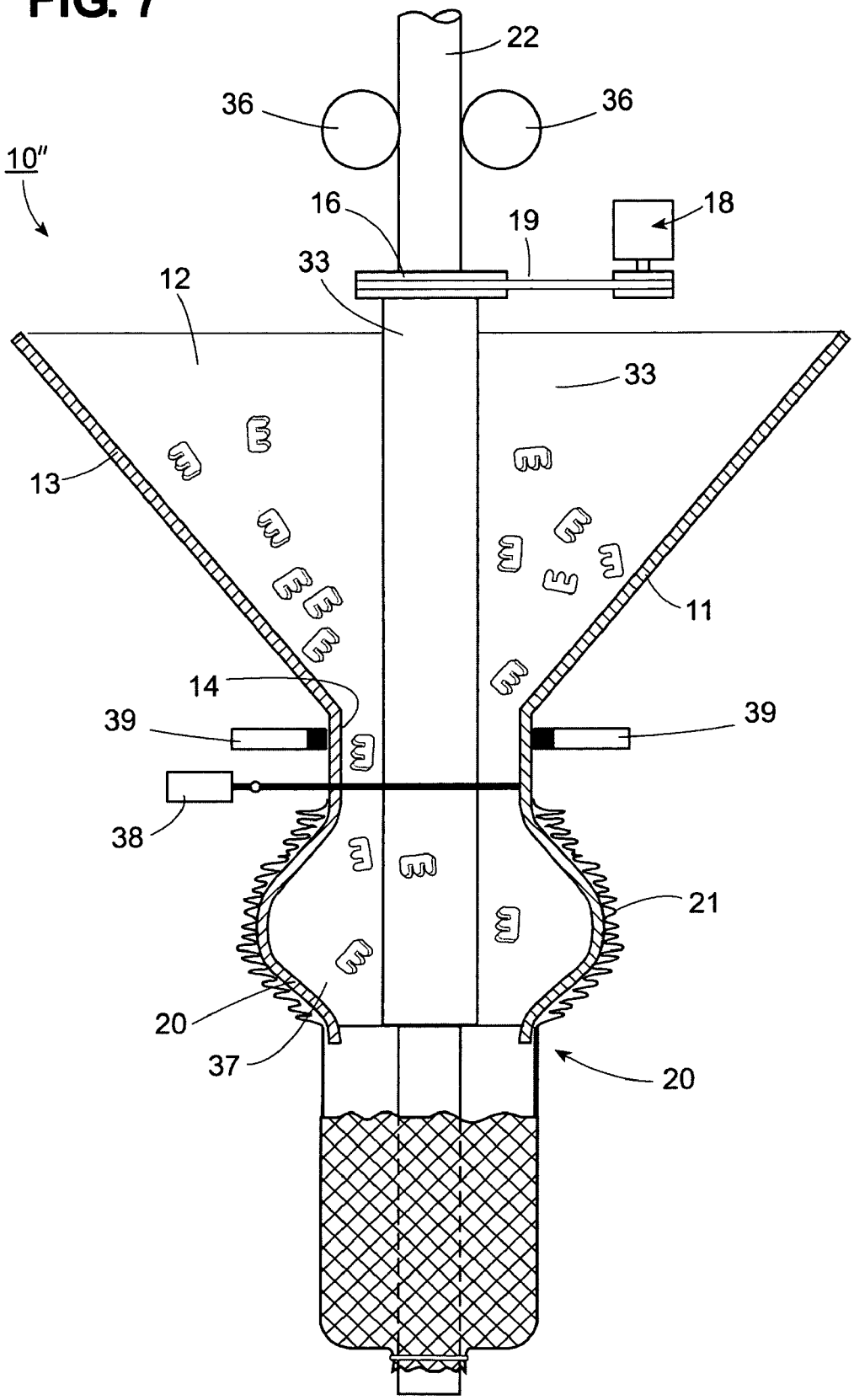
FIG. 7 illustrates a cross-sectional view of a modified apparatus in accordance with the invention.

Referring to FIG. 7 wherein like reference characters indicate like parts as above, the apparatus 10" may be constructed to operate under gravity without need of a metering means. As illustrated, the perforated pipe 22 is delivered by a pair of drive rolls 36, each of which has a concave central section to accommodate the cylindrical shape of the pipe 22, and is driven through the sleeve 33. In this case, the forward end of the mesh material 21 is secured to the pipe 22 and is pulled along with the pipe 22 as the drive rolls 36 push the pipe 22 through and out of the hopper 11. During operation, the aggregate is dispensed under gravity into the annular space forming between the pipe 22 and the mesh material 21.

As shown, an extension 37 is secured to the outlet 14 of the hopper 11 that has a bell-shaped cross-sectional shape. The mesh material 21 is received and retained about the upper section of the extension until such time as the mesh material is played off the extension 37 by a downward pull effected by the movement of the pipe 22. At this time, the mesh material 21 expands radially to move over the bell-shaped part of the extension and, after filling, contracts radially to a smaller diameter to cause a tight encapsulation of the aggregate 12.

The apparatus 10" may also be provided with a gate 38 for selectively opening and closing the outlet 14 of the hopper 11 for dispensing of the aggregate 12. In this respect, closing of the gate 38 stops the flow of aggregate 12 from the hopper 11 to allow time for the trailing end of the mesh material 21 to be secured to the pipe 22 to complete a unit of drainage element and a fresh forward end of the mesh material 21 to be secured to the pipe 22 to begin the filling of the next drainage element.

The apparatus 10" may also be provided with a means 39 for vibrating the hopper 11, for example, from time to time in order to break up any jamming of the aggregate 12 within the outlet 12 of the hopper 11 and to assist in packing the aggregate 12 tightly within the mesh material 21. As illustrated, the vibrating means 39 is deployed about a junction of the main part of the hopper 11 and the outlet 12. In addition, the outlet 12 may be made with an expanding cross-section in a downward direction from the main part of the hopper 11 in order to reduce the risk of jamming of the aggregate 12 at that juncture.

Figure 8:
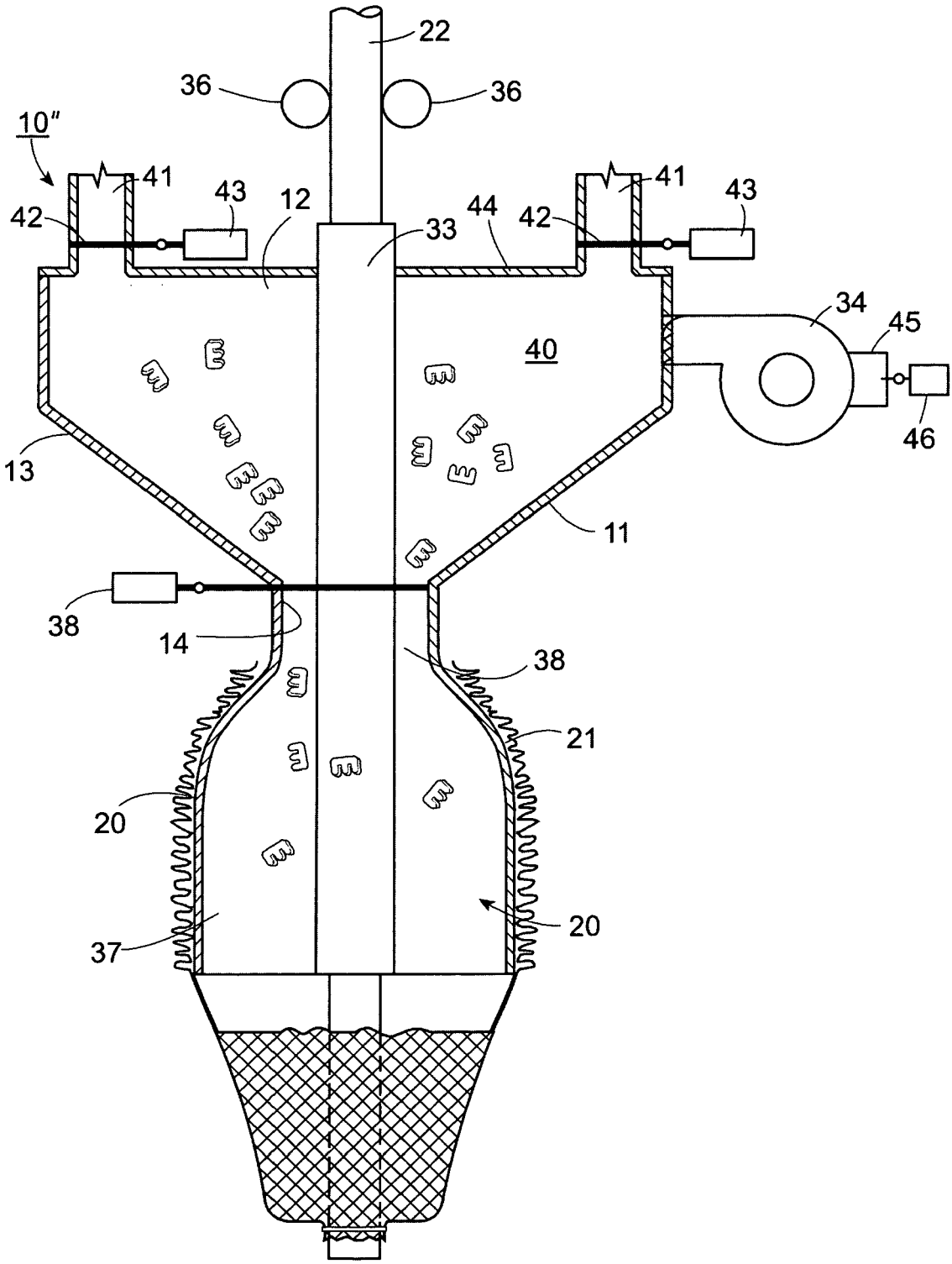
FIG. 8 illustrates a cross-sectional view of a modified apparatus in which a metered amount of aggregate is blown from a closed chamber of a hopper to fill a cylinder of mesh material.

Referring to FIG. 8, wherein like reference characters indicate like parts as above, the hopper 10 is constructed to define a closed chamber 40 and is provided with a gate 38 at the bottom of the chamber 40, as above, that is selectively movable between an open position allowing passage of aggregate from the chamber 40 into the outlet 14 and a closed position closing the chamber 40 in order to block passage of aggregate into the outlet 14.

A blower 34, as above, is disposed in communication with the interior of the hopper 10 for blowing air into the hopper chamber 40 to establish a pressure therein to push the aggregate within the chamber 40 downwardly into the outlet 14 when the gate 38 is opened while also blowing the aggregate downwardly.

In addition, a pair of delivery pipes 41 are disposed above the hopper 10 for delivering flows of aggregate into the chamber 40 of the hopper 10. In this respect, a gate 42 is disposed within each pipe 41 that is selectively movable between an open position allowing passage of aggregate from the pipe 41 into the chamber 40 and a closed position (as shown) closing the pipe 41 relative to the chamber 40 in order to block passage of aggregate into the chamber 40. Each gate 42 is moved by means of a piston and cylinder arrangement 43 of conventional structure.

Typically, each pipe 41 is connected to a cover 44 of the hopper 10 that closes the chamber 40 of the hopper 10 and communicates with the chamber 40 through an opening in the cover 44.

The pipes 41 and gates 42 constitute a means for delivering a metered amount of aggregate into the chamber 40 of the hopper 10. In this respect, the apparatus is provided with a suitable central control unit (not shown) that coordinates the operation of the gates 42 in the pipes 41, the gate 38 in the bottom of the hopper 10 adjacent to the outlet 14 and the blower 34. For example, with the gate 38 closed, the gates 42 in the pipes 41 are open so that aggregate may flow into the chamber 40 of the hopper 10. After a metered amount of aggregate has been delivered, the gates 41 are closed to block further delivery of aggregate. In this respect, a metered amount of aggregate may be delivered based upon the time that the gates 42 are opened or through a weight control within the hopper 10 or other sensing means (not shown) in the hopper 10 for determining the height of aggregate within the hopper 10.

After the hopper 10 has been charged with aggregate and the gates 42 closed, the gate 38 is opened and the blower 34 activated to blow air into the chamber 40 to pressurize the chamber 40 and force the aggregate 12 downwardly through the outlet 14 into the mesh material 20 in order to form a drainage element in a manner as described above.

Alternatively, the hopper 10 may be operated in a manner that does not deliver a metered amount of aggregate. For example, the delivery pipes 41 may be opened and closed via the gates 42 to deliver aggregate 12 into the hopper chamber 40 in an amount sufficient to maintain at least some aggregate in the chamber 40 while the lower gate 38 is open and aggregate 12 is being dispensed therethrough.

The blower 34 is operated on a continuous basis. In this respect, the blower 34 is provided with a gate 45 at an air inlet that is movable between a closed position and an open position by means of a piston and cylinder arrangement 46. When the gate 45 is opened, air is drawn through the inlet into the blower 34 and delivered into the hopper chamber 40 under a slight pressure. When the gate 45 is closed, air is not drawn into the blower 34 for delivery into the chamber 40 and the blower free-wheels. Since there is no need to turn the blower 34 on and off, there is a savings in the electrical energy used to run the blower 34.

The parts of the several embodiments described above may be used in the other described embodiments. For example, the bell shaped extension of the FIG. 7 embodiment may be used in the other embodiments and drive rolls may be used in all of the embodiments to positively drive the pipe 22 through the hopper.

The invention thus provides an apparatus for making drainage elements in a rapid simple economical manner. In particular, the apparatus allows the drainage elements to be made on a vertical axis and under gravity flows.

The invention thus provides a relatively simple technique for fabricating drainage elements employing loose fill aggregate about a perforated plastic pipe. Further, this technique allows a drainage element to be produced that has a uniform distribution of the aggregate about the pipe and uniform drainage characteristics.

What is claimed is:

1. An apparatus for making drainage elements, said apparatus comprising a hopper disposed about a vertical axis for receiving a supply of loose aggregate, said hopper having an outlet of cylindrical shape disposed to receive a collapsed cylinder of mesh material about a lower end thereof; and means for guiding a length of material through said outlet of said hopper while dispensing the aggregate through said outlet of said hopper into an annular space between the length of material passing out of said hopper and the cylinder of mesh material secured at one end to and moving with the length of material.

2. An apparatus as set forth in claim 1 further comprising metering means in said hopper for moving aggregate through said outlet of said hopper and circumferentially about said length of material in a uniform manner while pushing the aggregate through said outlet of said hopper into an annular space between the length of material passing out of said hopper and the cylinder of mesh material secured at one end to and moving with the length of material.

3. An apparatus as set forth in claim 2 wherein said metering means includes a hollow mandrel extending through said hopper on said axis, said mandrel having a bore for passage of the length of material therethrough and a screw-threaded flight extending about and along an outer periphery thereof for pushing aggregate through said outlet of said hopper.

4. An apparatus as set forth in claim 3 wherein said flight has an outer diameter sufficiently smaller than an internal diameter of said outlet of said hopper to block loose aggregate from backing up into said hopper from said outlet during relative rotation between said mandrel and said hopper.

5. An apparatus as set forth in claim 4 wherein said flight has a larger diameter at an upper end thereof than at a lower end thereof.

6. An apparatus as set forth in claim 3 further comprising a motor mounted above said hopper and operatively connected to said mandrel for rotating said mandrel about said vertical axis.

7. An apparatus as set forth in claim 6 wherein said motor is reversible.

8. An apparatus as set forth in claim 3 wherein said means for guiding is a sleeve fixedly mounted in said hopper and within said hollow mandrel.

9. An apparatus as set forth in claim 3 wherein said flight extends to an upper end of said outlet of said hopper.

10. An apparatus as set forth in claim 1 further comprising a blower in communication with an interior of said outlet for blowing air into said outlet in a downwardly directed manner.

11. An apparatus as set forth in claim 1 wherein said means for guiding is a sleeve mounted in said hopper and which further comprises a second sleeve mounted on and about said outlet of said hopper and having a collapsed cylinder of mesh material thereon.

12. An apparatus as set forth in claim 1 further comprises an extension secured to said outlet and having a bulbous cross-sectional shape for receiving a cylinder of mesh material on an upper section thereof.

13. An apparatus as set forth in claim 12 further comprising a gate for selectively opening and closing said outlet for the dispensing of the aggregate.

14. An apparatus as set forth in claim 1 further comprising a pair of drive rolls for driving the length of material through said hopper.

15. An apparatus as set forth in claim 14 further comprising means for vibrating said hopper.

16. An apparatus as set forth in claim 1 further comprising means for delivering a metered amount of aggregate into said hopper and a blower in communication with the interior of said hopper for blowing aggregate in said hopper through said outlet.

17. An apparatus as set forth in claim 16 wherein said hopper defines a closed chamber and said means for delivering aggregate includes at least one pipe for delivering a flow of aggregate and a first gate selectively movable between an open position allowing passage of aggregate from said pipe into said chamber and a closed position closing said pipe to said chamber to block passage of aggregate into said chamber.

18. An apparatus as set forth in claim 17 further comprising a second gate in said hopper selectively movable between an open position allowing passage of aggregate from said chamber into said outlet and a closed position closing said chamber to said outlet to block passage of aggregate into said outlet.

19. An apparatus as set forth in claim 18 wherein said blower is selectively operable to blow air into said chamber with said first gate in said closed position thereof and said second gate in said open position thereof.

20. An apparatus as set forth in claim 1 wherein said hopper defines a closed chamber and further comprising at least one pipe for delivering a flow of aggregate into said chamber, a first gate selectively movable between an open position allowing passage of aggregate from said pipe into said chamber and a closed position closing said pipe to said chamber to block passage of aggregate into said chamber and a blower in communication with the interior of said hopper for blowing air into said chamber to pressurize said chamber and push the aggregate in said chamber downwardly through said outlet.

21. An apparatus as set forth in claim 20 further comprising a second gate in said hopper selectively movable between an open position allowing passage of aggregate from said chamber into said outlet and a closed position closing said chamber to said outlet to block passage of aggregate into said outlet.

22. An apparatus as set forth in claim 21 wherein said blower is operable to blow air into said chamber with said first gate in said closed position thereof and said second gate in said open position thereof.

23. An apparatus for making drainage elements, said apparatus comprising a hopper disposed about a vertical axis for receiving a supply of loose aggregate, said hopper having an outlet of cylindrical shape on said axis for receiving a collapsed cylinder of mesh material about a lower end thereof;

a hollow mandrel extending through said hopper and disposed on said axis, said mandrel having a centrally disposed bore for passage of a length of material therethrough and a screw-threaded flight extending about and along an outer periphery thereof; and means for rotating said mandrel relative to said hopper to effect movement of loose aggregate in said hopper into and through said outlet of said hopper whereby the loose aggregate is pushed through said outlet of said hopper into an annular space between the length of material passing out of said hopper and the cylinder of mesh material secured at one end to and moving with the length of material.

24. An apparatus as set forth in claim 23 wherein said flight extends into said outlet of said hopper.

25. An apparatus as set forth in claim 24 wherein said flight has an outer diameter sufficiently smaller than an internal diameter of said outlet of said hopper to block loose aggregate from backing up into said hopper from said outlet during relative rotation between said mandrel and said hopper.

26. An apparatus as set forth in claim 24 wherein said flight has a larger diameter at an upper end thereof than at a lower end thereof.

27. An apparatus as set forth in claim 23 wherein said flight extends to an upper end of said hopper.

28. An apparatus as set forth in claim 23 further comprising a sleeve mounted on and about said outlet of said hopper and having a collapsed cylinder of mesh material thereon.

29. An apparatus as set forth in claim 23 wherein said means for rotating said mandrel includes a motor mounted above said hopper and operatively connected to said mandrel for rotating said mandrel about said vertical axis.

30. An apparatus as set forth in claim 29 wherein said motor is reversible.

31. An apparatus as set forth in claim 23 further comprising a blower in communication with an interior of said outlet for blowing air into said hopper to pressurize said hopper and to push aggregate downwardly into said outlet.

* * * * *